US007142119B2

(12) United States Patent
Siefke et al.

(10) Patent No.: US 7,142,119 B2
(45) Date of Patent: Nov. 28, 2006

(54) MONITORING AND ALARM SYSTEM

(75) Inventors: Wolfram Siefke, Heidelberg (DE); Jens Staeck, Sandhausen (DE)

(73) Assignee: SAP AG, Walldorf (DE)

( * ) Notice: Subject to any disclaimer, the term of this patent is extended or adjusted under 35 U.S.C. 154(b) by 98 days.

(21) Appl. No.: 10/878,992

(22) Filed: Jun. 30, 2004

(65) Prior Publication Data

US 2006/0001544 A1 Jan. 5, 2006

(51) Int. Cl.
*G08B 13/14* (2006.01)

(52) U.S. Cl. ..... 340/572.4; 340/539.1

(58) Field of Classification Search ..... 340/572.4, 340/572.1, 539.1, 568.1
See application file for complete search history.

(56) References Cited

U.S. PATENT DOCUMENTS

| | | | | |
|---|---|---|---|---|
| 4,418,411 | A | 11/1983 | Strietzel | |
| 4,429,299 | A | 1/1984 | Kabat et al. | |
| 4,837,568 | A * | 6/1989 | Snaper | 340/10.52 |
| 5,260,690 | A * | 11/1993 | Mann et al. | 340/572.2 |
| 5,886,634 | A | 3/1999 | Muhme | |
| 6,232,877 | B1 | 5/2001 | Ashwin | |
| 6,300,872 | B1 | 10/2001 | Mathias et al. | |
| 6,317,028 | B1 * | 11/2001 | Valiulis | 340/10.1 |
| 6,570,487 | B1 * | 5/2003 | Steeves | 340/5.2 |
| 6,717,517 | B1 * | 4/2004 | Przygoda, Jr. | 340/572.4 |
| 6,720,874 | B1 * | 4/2004 | Fufido et al. | 340/541 |
| 6,836,843 | B1 * | 12/2004 | Seroussi et al. | 713/173 |
| 6,972,683 | B1 * | 12/2005 | Lestienne et al. | 340/572.1 |
| 2002/0118111 | A1 | 8/2002 | Brown et al. | |

FOREIGN PATENT DOCUMENTS

| | | |
|---|---|---|
| EP | 1 316 814 A1 | 6/2004 |
| WO | WO00/75897 | 12/2000 |

* cited by examiner

*Primary Examiner*—John Tweel, Jr.
(74) *Attorney, Agent, or Firm*—Fish & Richardson P.C.

(57) ABSTRACT

A security system for providing monitoring of objects and persons is described. Person identifiers are assigned to, and generally carried by, the persons, where each person identifier is associated with at least one user role. Similarly, object identifiers are assigned to the objects, where each object identifier is assigned to at least one object class. An identification interrogator identifies the object and person identifiers within an area, and a rule generator determines rules defining which persons of which user roles, together with which objects of which object classes are, allowed and/or required within the area.

28 Claims, 6 Drawing Sheets

MONITORING AND ALARM SYSTEM

TECHNICAL FIELD

This description relates to an alarm and monitoring system.

BACKGROUND

It is known in the art to provide radio frequency identification (RFID) tags to persons and objects to allow identifying them. For instance, from U.S. Pat. No. 4,418,411 A, a method and an apparatus for interrogating such RFIDs is known. A stationary interrogator may interrogate a transponder fastened to the object or the living being. The transponder may obtain its energy from the transmission of the interrogator. Using this energy, the transponder may send its identification to the interrogator. Each of the transponders may carry a unique identification number. This unique identification number may be transmitted to the interrogator. The unique identification numbers allow identifying each of the transponders uniquely.

It is also known in the art to secure entries to buildings by using chip cards and chip card readers. It is possible to interrogate the chip cards of personnel at the entry to a building and to determine whether or not to grant access to the building. The chip cards may provide a unique identification number depending on the identified unique identification number read from the chip cards for each user. A security rule may be applied, which only allows entry to the building or particular areas within the building for certain individuals. These individuals may be identified by their identification cards, i.e., by their respective unique identification numbers. Entry and exit to buildings may thereby be controlled. It may also be logged which persons enter and exit which area of a building at which time. This information may, for instance, be used for updating a balance sheet of a person regarding the time present in the building.

Further, from U.S. 2001/0169583 A1, it is known to provide RFID tokens to persons. The tokens permit the persons to identify themselves within an area. It may also be possible to monitor different persons within a building, and to provide alarm signals, in case the identified persons do not act according to security rules. For instance, the presence of a person in a living room may be detected. It may also be detected that a person needing help is located in a bedroom. According to security rules, the reaction of the person in the living room may be monitored, and an alarm signal may be generated if none of a set of expected events, such as the person in the living room moving to the bedroom, is detected in a predefined interval.

SUMMARY

As described below, systems, methods, and computer program products are provided for monitoring a relationship between persons and objects within an area. Further, the persons recognized within the area may be distinguished from each other. Rules may be used that consider the recognized persons in combination with classes, states, and locations of objects, perhaps in relation to the location(s) of certain ones of the persons. The rules may further consider defined roles of the persons, such as, for example, a job title or security clearance.

More specifically, for example, the present invention provides a security system providing monitoring of objects and persons, with a classifier operable to associate a person identifier and user role with each of the persons, and further operable to associate an object identifier and object class with each of the objects. An identification interrogator is provided for identifying the object and person identifiers within an area, and a rule generator determines rules defining which persons of which user roles together with which objects of which object classes are allowed or required within the area. A controller is connected to the identification interrogator and checks whether the identified identifications comply with the rules.

As just mentioned, each person may be assigned to at least one user role. The user role may classify certain persons into groups with certain attributes. For instance, certain abilities, characteristics, or job titles of persons may account for a user role. Thus, persons having the particular ability, characteristic, or job title may be assigned to this user role. The user role for each person identifier may be stored within a database. Due to privacy reasons the person identifier need not be unique. It may also be possible to determine from the person identifier only the user role, without any individual identification information (e.g., unique number).

Processing the rules may occur solely upon identification of a user role. The user role may be read from the person identifiers; however, individual identification need not be read. The rule compliance may be checked based solely on the user role. The controller may check the rule compliance without otherwise identifying the individual ID of a person.

In case the person identifier includes, or is interrogated from, for instance, an RFID tag, the respective user role may be determined from the database. For instance, a technician may have a different user role than a bookkeeper. Another example may be a child that belongs to a different user role than an adult. A further user role may, for instance, be defined by the gender of the person. Any other classification of users and user roles, according to attributes of the users, is also possible. By providing the user role, persons may be categorized into groups.

Object classes may also be defined. These object classes may allow classifying objects into groups, according to attributes of the objects. For instance, a fragile object may be classified into a different object class than a robust object. As another example, different chemicals may be assigned to different object classes, according to how hazardous the chemicals are.

For each object identified within an area, the respective object class may be retrieved from a database (e.g., the classifier mentioned above). Within the database, a mapping between an object identifier and a particular object class may be possible.

To monitor a certain area, such as, for example, a building, a room or a certain area within a building, or a defined outside area, an identification interrogator may be provided. This identification interrogator may interrogate the identifiers, for example, by using high frequency interrogating signals. The interrogator may be designed to allow monitoring only of a particular area. By monitoring the particular area, all persons and objects may be identified using their identifiers. These identifiers may be tangibly attached to the persons or objects. Also, persons may carry their person identifiers as a badge or as a chip card.

To provide security and other features, a rule generator may be provided. This rule generator may define rules. These rules may establish combinations of user roles and objects/object classes that are allowed or required within a certain area. For example, it may be defined whether certain persons having certain user roles need to be within a particular area. It may also be defined which objects of certain object classes are allowed within particular areas. In addition, it may be defined which persons of which user roles in combination with which objects of which object classes are allowed and/or required within particular areas.

For instance, certain objects, such as those classified as hazardous, may require persons of certain user roles, for example technicians, to be located within the same area. Another example might be that a person of the user role bookkeeper may not enter a room if, within the room, a person classified as technician is working with an object classified as hazardous. In this case, access may be denied to the bookkeeper until certain further conditions are fulfilled (for example, until the hazardous object is removed or contained).

To control whether particular rules are fulfilled, a controller connected to the identification interrogator may be provided. This controller may check whether the identified identifiers comply with the rules. The controller may be responsible for compliance with the defined rules. In case the identified persons and objects and their roles and classes do not comply with desired conditions as set forth by the rules, the controller may initiate actions to change this state. For example, the controller may issue an alarm signal, or any other signal, or may automatically send an email to a supervisor of the monitoring system.

An alarm signal may, for instance, be any acoustical or optical signal. An alarm signal may also be a signal sent to a supervision station where a supervisor may react to the alarm signal and take any necessary steps to control the situation.

In some implementations, the person identifiers or the object identifiers may be wirelessly accessible tags, including, for example, RFID tags. Such tags may be interrogated wirelessly to monitor an area, without having to connect person identifiers and object identifiers to the interrogator. The wirelessly accessible tags may, for instance, be interrogated using high frequency. The area monitored may be restricted.

Accessing the object identifications may, in some implementations, be possible using a power line of the objects that is providing electrical power to the objects. For example, many objects, such as electrically driven devices, including ovens, microwaves, irons, and furnaces, may be interrogated using their power line connection.

This may also allow interrogating the state of the devices, such as, for example, whether the device is currently on or off. Insofar as rules may be defined that also take states of objects into account, it may be possible to monitor devices in connection with their states and the availability of persons of particular user roles within an area.

As non-compliance with the rules may result in dangerous situations in some cases, or may necessitate further actions to be taken, some implementations provide for the controller to generate an alarm signal in case the identified identifications do not comply with the rules, similarly to the implementations described above. The alarm signal may, for instance, be an acoustical or optical signal. An alarm signal may also be a signal sent to a supervision station where a supervisor may react to the alarm signal and takes any necessary steps to correct the situation.

To allow regulating of accessing and exiting certain areas based on the availability of objects and persons of certain classes and roles within the area, implementations provide an access controller controlling access to the area, such that a person may enter or exit the area only if the identified identifiers still comply with the rules after the person has entered or exited the area.

One possible example of such an implementation may be that an object classified as hazardous is within a room, and the rules require a person in the room who is classified as technician. In case that the only currently-present technician wants to exit this room, the controller might detect that the technician's exit would result in non-compliance with the rules. Therefore, exit to the room would not be granted to the technician.

Another example may be that an oven is turned on. The oven may be classified as object class "dangerous." The rules may require that an adult is within the house if the oven is turned on. In this case, the controller would identify non-compliance with the rules if the only person of the user role adult wanted to exit the house. Exit may be denied, or, in other implementations, a warning message may be generated.

According to other implementations, rules may define user roles, to which, in combination with objects of an object class, exit to and/or exit from an area is allowed. For example, certain materials may only be removed from certain areas by authorized persons. The materials may be classified as "limited removability." The persons allowed to remove these materials may be in the user role "extended access." If a person of the user role "extended access" wants to remove the material of "limited removability" from a room, this is in compliance with the rules and exit is granted. Any other person of a different user role may not remove this material, and as such, exit from the room may be denied for these persons. To control exit and entry, the identifiers may need to be interrogated during exiting and entering certain areas.

According to further implementations, the object states may also be accounted for. In these cases, the interrogator may also identify states of objects. The rule generator may generate rules defining which persons of which user roles, in combination with which objects of which object classes and in which object state, are allowed and/or required within the area. This may, for example, provide increased security in case object states may change from "normal" to "dangerous." For instance, it may be possible to check the state of an oven, e.g., whether it is turned on or off. For instance, if the identified oven within the area is in the state "on" and an adult is detected in the house, a certain rule may be complied with. If the adult leaves the house, or if the oven is turned "on" in case no adult is within the house, non-compliance with certain rules may be detected and certain measures may be taken, including, for example, sounding of an alarm.

To provide centralized control over user roles and object classes, some implementations provide a central database connected to the controller and providing a user role for each identified person and/or an object class for each identified object. By providing the central database, persons and objects may be classified centrally. Centrally changing user roles of certain persons and object classes of certain objects may be possible. This may, for instance, be useful in case of a centralized data management, such as in enterprise resource planning (ERP) software. In master data management (MDM) software, data of objects may be stored centrally. Each object may be assigned a certain object class out of a list of different object classes. Also, a user may be assigned a user role out of a list of different user roles. This centralized approach may allow centralized control and monitoring.

To provide centralized control, implementations provide for connecting the rule generator to the central database and retrieving the rules from the central database.

A further aspect is a security system providing monitoring of objects and persons, with person identifiers assigned to the persons, where each person identifier is assigned to at least one user role. Object identifiers are assigned to the objects, where each object identification is assigned to at least one object class. An identification interrogator identifies the object and person identifiers within an area, and a central database provides user roles for each identified person, and object classes for each identified object. A rule generator connected to the central database determines rules from information from the central database defining which persons of which user roles together with which objects of which object classes are allowed or required within the area. A controller connected to the identification interrogator checks whether the identified identifications comply with the rules, and an access controller controls access to the area such that a person is allowed to enter or exit the area only if the identified identifiers still comply with the rules after the person has entered or exited the area.

Another aspect provides a method for monitoring persons and objects by interrogating person identifiers assigned to the persons, where each person identifier is assigned to at least one user role, by interrogating object identifiers assigned to the objects, where each object identifier is assigned to at least one object class, by determining rules defining which persons and which objects are allowed or required within the area, based on the user roles and object classes, and by checking whether the identified identifiers comply with the rules.

One further aspect is a computer program product for monitoring persons and objects, the computer program product comprising a computer program operable to cause a computer to instruct an interrogator to interrogate person identifiers assigned to the persons, where each person identifier is assigned to at least one user role, and interrogate object identifiers assigned to the objects, where each object identifier is assigned to at least one object class, and to instruct a rule generator to determine rules defining which persons and which objects are allowed or required within the area, based on the user roles and object classes, and check whether the identified identifiers comply with the rules.

Yet a further aspect of the invention is a computer program for monitoring persons and objects, with instructions operable to cause a computer to instruct an interrogator to interrogate person identifiers assigned to the persons, where each person identifier is assigned to at least one user role, and interrogate object identifiers assigned to the objects, where each object identifier is assigned to at least one object class, and to instruct a rule generator to determine rules defining which persons and which objects are allowed or required within the area, based on the user roles and object classes, and check whether the identified identifiers comply with the rules.

Referring now to the drawings, in which like numerals represent like elements throughout the several figures, aspects of the present invention and example operating environments will be described.

DETAILED DESCRIPTION

In FIGS. 1 to 6, while reference numbers 100/200, 110/210 . . . denote similar elements, the function of these elements may be different.

Figure 1:
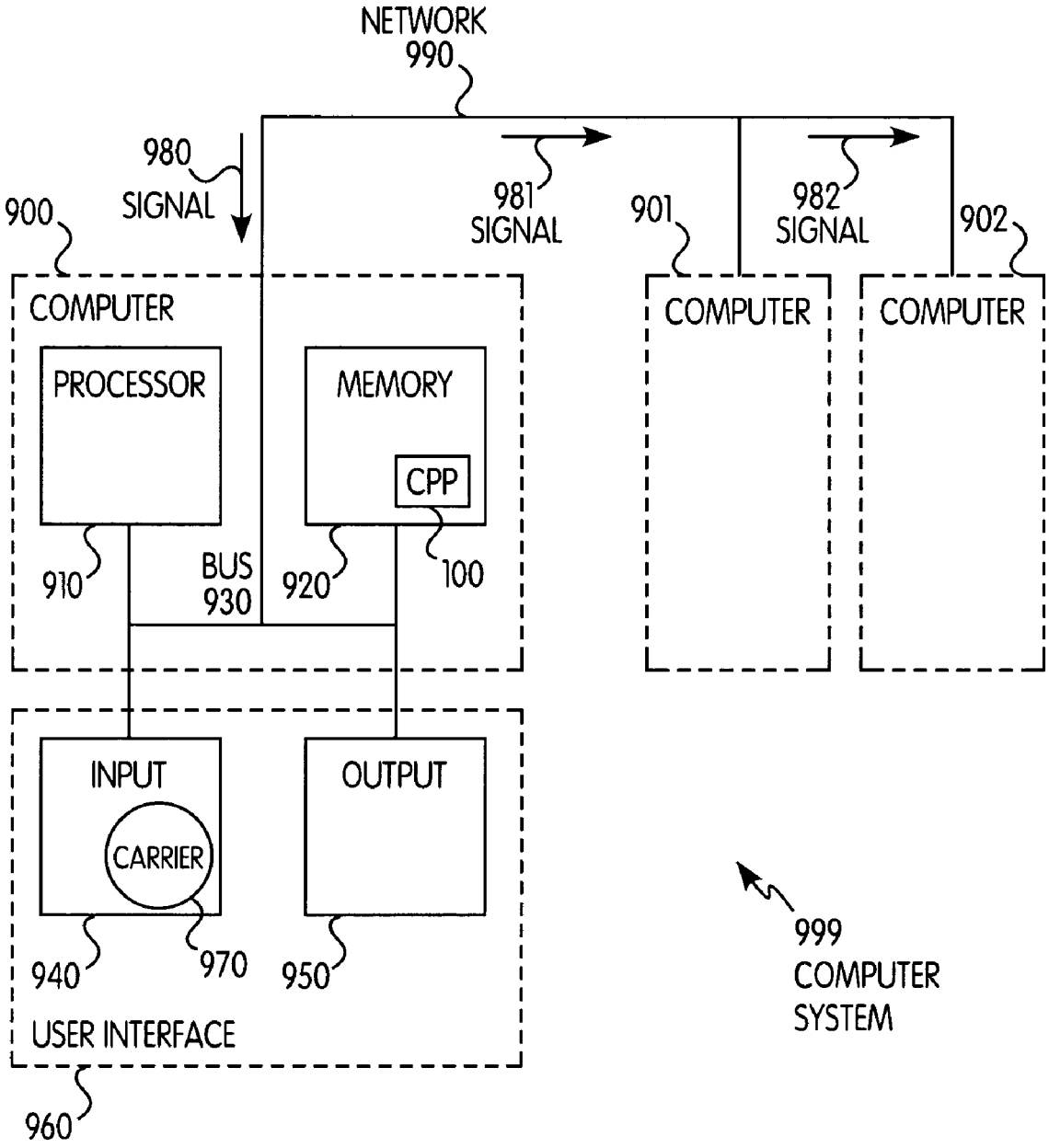
FIG. 1 is a block diagram of a computer system that may be used to implement a monitoring and alarm system.

The invention may be implemented by a computer system, an example of which is illustrated in FIG. 1. FIG. 1 illustrates a simplified block diagram of exemplary computer system 999 having a plurality of computers 900, 901, 902 (or even more).

Computer 900 can communicate with computers 901 and 902 over network 990. Computer 900 has processor 910, memory 920, bus 930, and, optionally, input device 940 and output device 950 (I/O devices, user interface 960). As illustrated, the invention is implemented by computer program product 100 (CPP), carrier 970 and signal 980.

With respect to computer 900, computer 901/902 is sometimes referred to as "remote computer." Computer 901/902 is, for example, a server, a peer device or other common network node, and typically has many or all of the elements described relative to computer 900.

Computer 900 is, for example, a conventional personal computer (PC), a desktop device or a hand-held device, a multiprocessor computer, a pen computer, a microprocessor-based or programmable consumer electronics device, a minicomputer, a mainframe computer, a personal mobile computing device, a mobile phone, a portable or stationary personal computer, a palmtop computer or the like.

Processor 910 is, for example, a central processing unit (CPU), a micro-controller unit (MCU), digital signal processor (DSP), or the like.

Memory 920 is comprised of elements that temporarily or permanently store data and instructions. Although memory 920 is illustrated as part of computer 900, memory can also be implemented in network 990, in computers 901/902 and in processor 910 itself (e.g., cache, register), or elsewhere. Memory 920 can be read-only memory (ROM), random access memory (RAM), or memory with other access options. Memory 920 is physically implemented by computer-readable media, for example: (a) magnetic media, like a hard disk, a floppy disk or other magnetic disk, a tape, a cassette tape; (b) optical media, like an optical disk (CD-ROM, digital versatile disk—DVD); or (c) semiconductor media, like DRAM, SRAM, EPROM, EEPROM, or a memory stick.

Optionally, memory 920 may be distributed. Portions of memory 920 can be removable or non-removable. For reading from media and for writing in media, computer 900 uses well-known devices, for example, disk drives or tape drives.

Memory 920 stores modules such as, for example, a basic input output system (BIOS), an operating system (OS), a program library, a compiler, an interpreter, and a text-processing tool. Modules are commercially available and can be installed on computer 900. For simplicity, these modules are not illustrated.

CPP 100 has program instructions and—optionally—data that cause processor 910 to execute method steps of the present invention. In other words, CPP 100 can control the operation of computer 900 and its interaction in network system 999 so that it operates to perform in accordance with the invention. For example and without the intention to be limiting, CPP 100 can be available as source code in any programming language, and as object code ("binary code") in a compiled form.

Although CPP 100 is illustrated as being stored in memory 920, CPP 100 can be located elsewhere. CPP 100 can also be embodied in carrier 970.

Carrier 970 is illustrated outside computer 900. For communicating CPP 100 to computer 900, carrier 970 is conveniently inserted into input device 940. Carrier 970 is implemented as any computer readable medium, such as a medium largely explained above (cf. memory 920). Generally, carrier 970 is an article of manufacture having a computer-readable medium with computer-readable program code to cause the computer to perform methods of the present invention. Further, signal 980 can also embody computer program product 100.

Having described CPP 100, carrier 970, and signal 980 in connection with computer 900 is convenient. Optionally, further carriers and further signals embody computer program products (CPP) to be executed by further processors in computers 901 and 902.

Input device 940 provides data and instructions for processing by computer 900. Device 940 may be a keyboard, a pointing device (e.g., mouse, trackball, cursor direction keys), microphone, joystick, game pad, scanner, or disc drive. Although the examples are devices with human interaction, device 940 can also be a device without human interaction, for example, a wireless receiver (e.g., with satellite dish or terrestrial antenna), a sensor (e.g., a thermometer), or a counter (e.g., a goods counter in a factory). Input device 940 can serve to read carrier 970.

Output device 950 presents instructions and data that have been processed. For example, this can be a monitor or a display, cathode ray tube (CRT), flat panel display, liquid crystal display (LCD), speaker, printer, plotter, vibration alert device, cellular phone, or mobile device (PDA). Output device 950 can communicate with the user, but it can also communicate with further computers.

Input device 940 and output device 950 can be combined to a single device. Any device 940 and 950 can be provided optionally.

Bus 930 and network 990 provide logical and physical connections by conveying instruction and data signals. While connections inside computer 900 are conveniently referred to as "bus 930," connections between computers 900–902 are referred to as "network 990." Optionally, network 990 includes gateways, which are computers that specialize in data transmission and protocol conversion.

Devices 940 and 950 are coupled to computer 900 by bus 930 (as illustrated) or by network 990 (optionally). While the signals inside computer 900 are mostly electrical signals, the signals in network are electrical, electromagnetic, optical or wireless (radio) signals.

Networks are commonplace in offices, enterprise-wide computer networks, intranets and the Internet (e.g., the world wide web). Network 990 can be a wired or a wireless network. To name a few network implementations, network 990 can be, for example, a local area network (LAN), a wide area network (WAN), a public switched telephone network (PSTN); an Integrated Services Digital Network (ISDN), an infrared (IR) link, a radio link such as Universal Mobile Telecommunications System (UMTS), Global System for Mobile Communication (GSM), Code Division Multiple Access (CDMA), or satellite link.

A variety of transmission protocols, data formats and conventions is known, for example, as transmission control protocol/internet protocol (TCP/IP), hypertext transfer protocol (HTTP), secure HTTP, wireless application protocol (WAP), unique resource locator (URL), a unique resource identifier (URI), hypertext markup language (HTML), extensible markup language (XML), extensible hypertext markup language (XHTML), wireless markup language (WML), or Standard Generalized Markup Language (SGML).

Interfaces coupled between the elements are also well known in the art. For simplicity, interfaces are not illustrated. An interface can be, for example, a serial port interface, a parallel port interface, a game port, a universal serial bus (USB) interface, an internal or external modem, a video adapter, or a sound card.

Computer and program are closely related. As used hereinafter, phrases such as "the computer provides" and "the program provides" are convenient abbreviations to express actions by a computer that are controlled by a program.

Figure 2:
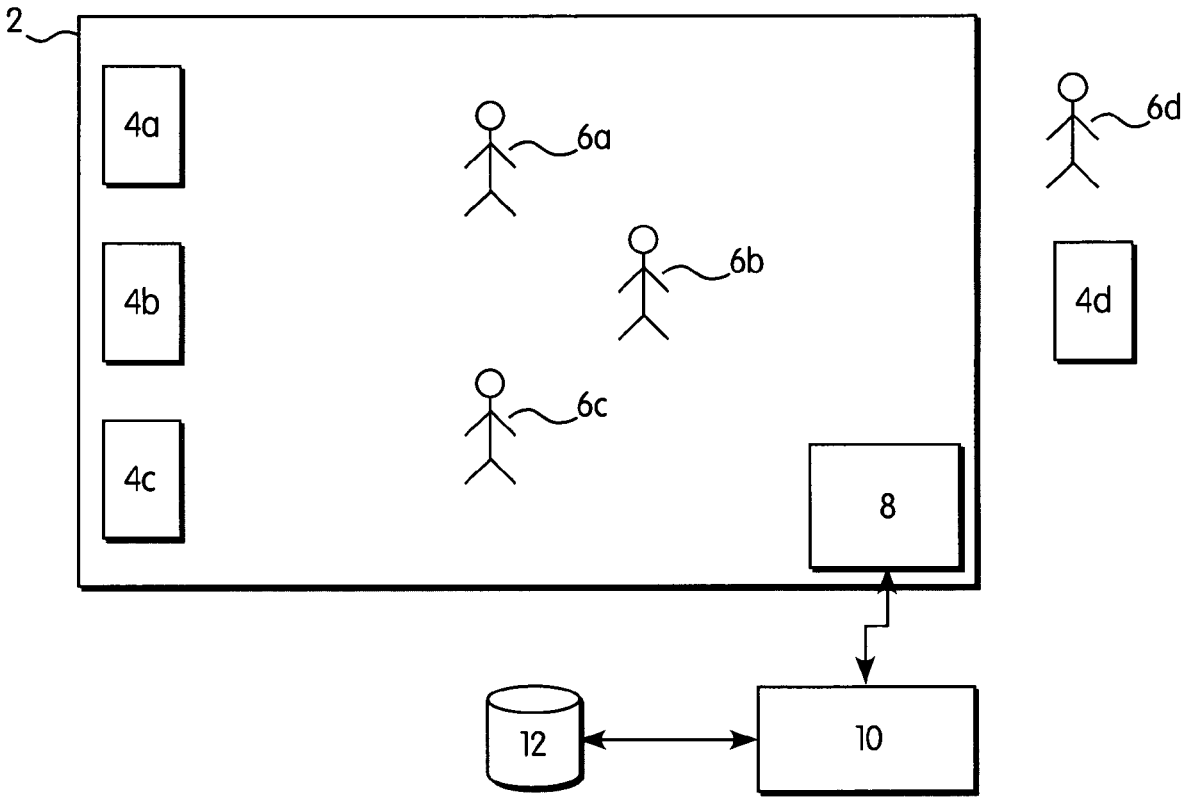
FIG. 2 is a block diagram of a first implementation of a monitoring and alarm system.

FIG. 2 illustrates an area 2, for example a room or a building, or any other area. It should be understood that the area 2 may represent a very large building, or a large number of rooms. The area 2 may even include a first portion within a building, and a second portion outside of the building, or may represent an area that is entirely external to a building. As a result, it is possible that persons within the area 2 may not be able to visibly see or otherwise determine a number of other persons within the area, if any.

Within and around the area 2, different objects 4*a–d* are located. Further located within and around the area 2 are persons 6*a–d*. In addition, an interrogator 8 is located within the area 2. The interrogator 8 is connected to a controller 10. The controller 10 may retrieve data from a database 12. The persons 6*a–d* and the objects 4*a–d* each carry a unique identification or identifier, such as, for example, a RFID tag. The RFID tags may comprise identification numbers, which may be unique to the individual user. The unique identification numbers may be used to identify the persons 6*a–d* and the objects 4*a–d*.

Interrogator 8 interrogates area 2. During interrogation of area 2, interrogator 8 may read all RFID tags of the objects 4*a–c* and the persons 6*a–c* within area 2. Persons 6*d* and objects 4*d*, which are depicted outside of area 2, would not be read out by interrogator 8 in this scenario.

After the unique identification numbers are read, they are transmitted from interrogator 8 to controller 10. Within controller 10, the unique identification numbers are used for mapping the identified persons 6*a–c* onto user roles, and for mapping the identified objects 4 onto object classes. For example, each of the persons 6 may have a different user role, and each of the objects 4 may also have a different object class. Additionally, or alternatively, different persons or objects may be classified into groups of persons or objects, respectively.

Database 12 may store rules, and may store the classifications associating person identifiers with persons and their user roles, and associating object identifiers with objects and object classes. The controller 10 may retrieve the classifications and rules from the database 12. The rules may define, for example, which persons of certain user roles, together with which objects of certain object classes, are required within area 2. Controller 10 may apply these rules and check whether the persons 6*a–c* and the objects 4*a–c* comply with the rules.

For example, area 2 may be a nuclear power plant. In this example, object 4*a* may be classified as within object class "radioactive." Object 4*b* may be classified as object class "computer" and object 4*c* may be classified as object class "chemical." Further, person 6*a* may be classified as being of user role "physicist." Person 6*b* may be classified as being of user role "chemist." In addition, person 6*c* may be identified as of user role "electrical engineer."

Interrogator 8 interrogates the identifications of the persons 6*a–c* and the objects 4*a–c*, and identifies the respective user roles and object classes. The rules may request that in case radioactive material is within area 2, a physicist and an electrical engineer are required within area 2. As in the current example person 6*a* is identified as physicist and person 6*c* is identified as electrical engineer, the present condition complies with the rule.

In some cases, it may occur that radioactive material is assumed always to be present in the area 2. In this case, the rule may simply require that at least one physicist and one electrical engineer are always present within area 2. That is, the rule may not require a simultaneous check for the presence of radioactive material, and may thereby save time and other resources (e.g., the number of required interrogations) in implementing the rule.

A further rule may be defined, which requests that in case a chemical is in the area 2, a chemist is required within the area 2. As in the current case the person 6*b* is identified as chemist, this rule is also complied with.

It should be noted in the above examples that the unique identifiers and/or identification numbers may be unique to the user role, and not necessarily unique to the individual person. For example, all chemists may be assigned the same identification number. In this way, private information regarding an individual chemist may be protected, and resource usage (e.g., memory and processing requirements) may be minimized.

Figure 3:
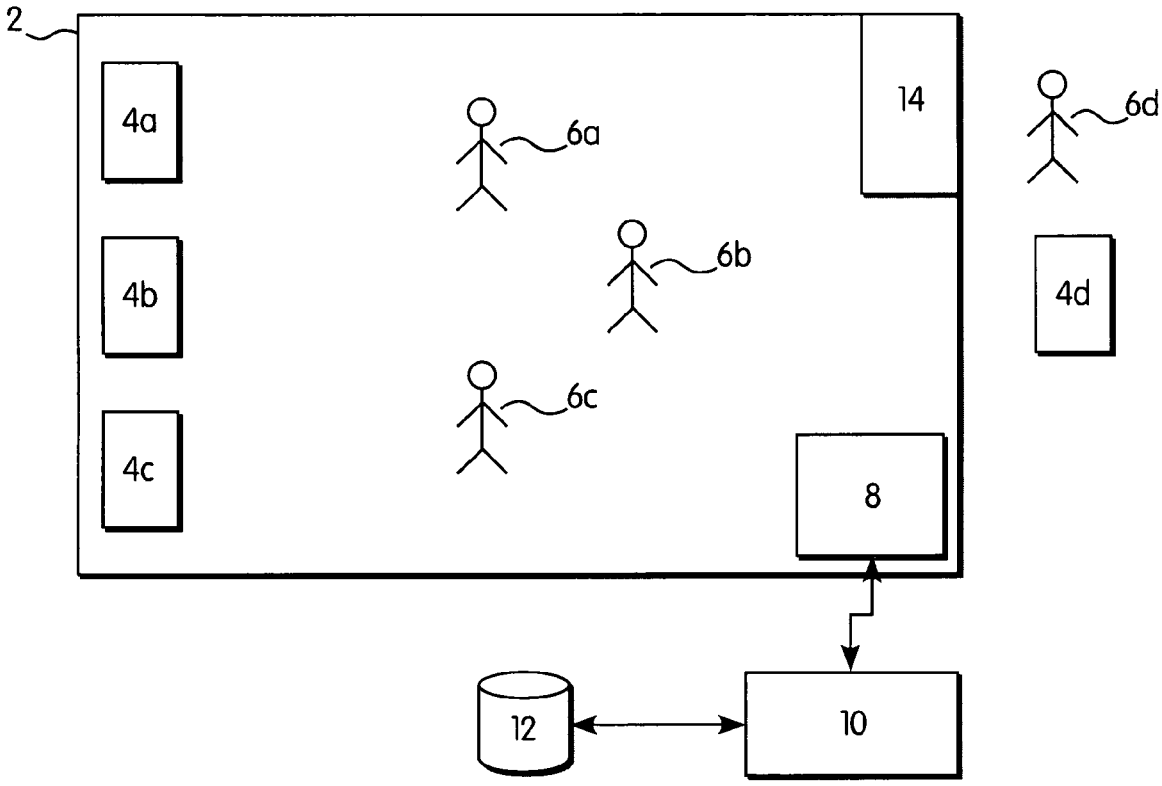
FIG. 3 is a block diagram of a second implementation of a monitoring and alarm system.

FIG. 3 shows a similar system as FIG. 2. In addition, an access control 14 is provided. By means of this access control 14, rules may be applied which allow controlling entry and exit to area 2.

For instance, one rule may be defined, which states that a bookkeeper may not enter area 2 if a chemical is within the room. For instance, in case person 6*d* wants to enter the room, his or her unique identification number is read using access controller 14. This unique identification number is sent to controller 10. Controller 10 retrieves the user role of person 6*d* from database 12. The user role of person 6*d* may be identified as being "bookkeeper."

Within area 2, object 4*c* has been identified as of object class "chemical." As the exemplary rule states that a bookkeeper is not allowed to enter the area 2 in case a chemical is within the room, in the current case access may be denied to person 6*d* by access controller 14.

Another example may be that a rule defines that only a chemist may exit the room carrying a chemical. In such a case, when person 6*a* wants to leave the area 2 carrying object 4*c*, access controller 14 retrieves the respective unique identification numbers from the RFID tags attached to person 6*a* and object 4*c*. Access controller 14 sends the unique identification numbers to controller 10. Controller 10 uses these unique identification numbers for determining the user role of person 6*a* and the object class of object 4*c*. These are determined as user role "physicist" and object class "chemical." As the exemplary rule states that only a chemist may exit the area 2 carrying a chemical, exit may be denied to person 6*a*, as this person is not of user role "chemist."

In case person 6*c* requests exit from area 2 carrying object 4*c*, again, its unique identification number as well as the unique identification number of object 4*c* are read by access controller 14. These numbers are used to determine the respective user role and object class. The determined unique identification number of person 6*c* allows classifying this person to user group "chemist." The determined unique identification number of object 4*c* allows classifying this object to object class "chemical." In such a case, person 6*c* would be allowed to exit area 2 carrying object 4*c*, as this would be in compliance with the exemplary rule.

The above examples are discussed with respect to user roles (e.g., chemist) and object classes (e.g., chemical). However, it should be understood that similar rules could be implemented with respect to individual users and/or individual objects. For example, if the only non-chemist in the area 2 is an administrative assistant, it may not be necessary for the system to create a user role of "administrative assistant." Rather, the system may include rules that apply solely to the administrative assistant based on the assistant's unique identification number. Similarly, a rule may apply to a specific chemical, rather than to the object class "chemical."

Another exemplary rule may request an electrical engineer in a room with a computer. In such a case, when person 6*c* requests to exit the room the request may be denied. From the unique identification numbers of persons 6*a–c* it may be determined that person 6*c* is the only electrical engineer. As non-compliance with the rule would occur when person 6*c* leaves the room, exit may be denied, or a warning message generated.

FIGS. 2 and 3 are discussed above with respect to rules for governing a presence, entrance, or exit of persons from the area 2. In the examples given, the rules govern combinations of users, user roles, objects, and object classes that may be present, enter, or exit the area 2. It should be understood that these are merely examples, and other examples also may exist. For example, as referred to above, the rules may also consider a current state of an object.

For instance, if the object is an electrical appliance, the rules may consider whether the appliance is on or off. In FIG. 2, then, if the object 4*a* is a stove, the controller 10 may determine from the rules of database 12 that a user having a user role "adult" must be present in the area 2 when the stove 4*a* is currently on. Similarly, in FIG. 3, the identified adult may be prevented from leaving the area 2 in the case where the stove 4*a* is determined to be on.

Figure 4:
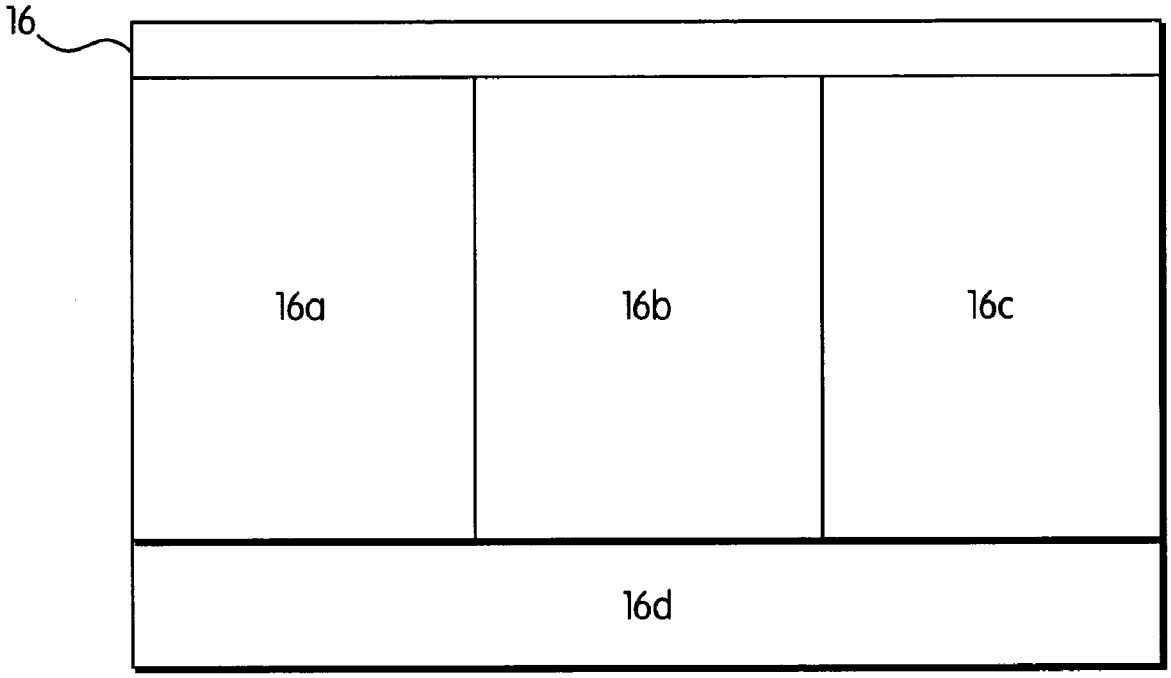
FIG. 4 is a screen shot of a monitoring computer program.

FIG. 4 shows a screen shot 16 of an example of an example computer system according to the invention. For instance, the screen shot 16 may comprise various windows 16*a–*16*d*. Window 16*a* may comprise a list of areas being monitored by different interrogators. These areas are selectable by a user. According to the user selection of the certain area within window 16*a*, in window 16*b* the respective person identifiers together with their determined user roles may be shown in a list in window 16*b*.

In addition, the identified object identifiers together with the determined object classes within the selected area may be shown in window 16*c*. In window 16*d*, rules may be shown which are defined for the respective rooms selected in window 16*a*. Further, compliance with these rules may be indicated with icons or colors within window 16*c*. For instance, if the persons and the objects in the room have user roles and object classes that comply with a particular rule, this rule may be underlined in green. On the other hand, if the persons in the room do not have the required user roles set forth by a further rule, this rule may be underlined in red. Also, an icon may indicate whether an alarm has been issued.

Figure 5:
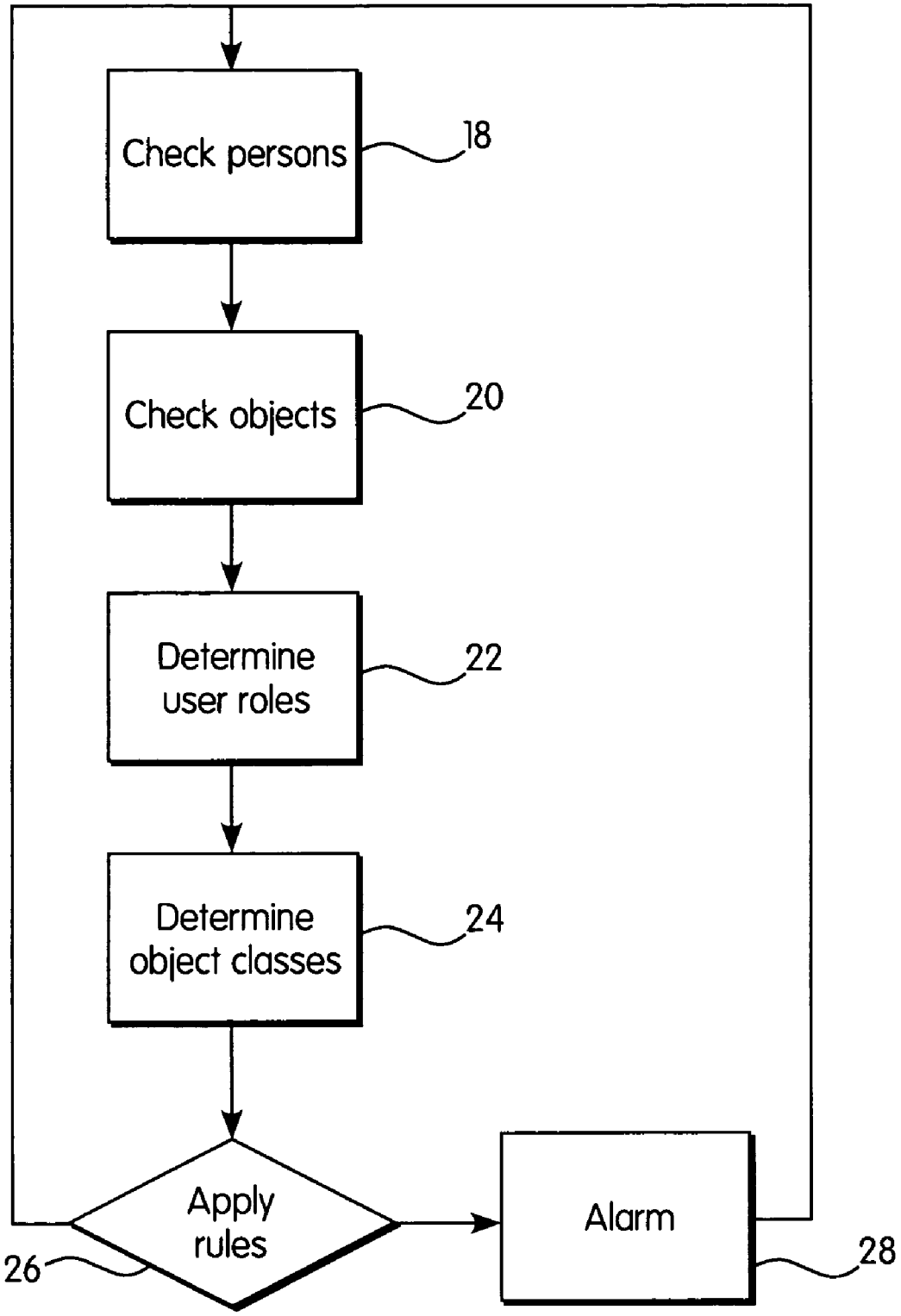
FIG. 5 is a flow chart illustrating example operations of the systems of FIGS. 1–4.

FIG. 5 shows a flow chart illustrating an example of a process flow of the system of FIG. 2. The person identifiers within a room are checked (18). Also, the object identifiers are checked (20). The determined person identifiers and object identifiers are sent to a controller and within the controller the respective user roles are determined from a database (22). Further, the respective object classes of the identified objects are determined from the database (24).

Using these user roles and object classes, compliance with various rules is checked (26). In case one of the rules is not complied with, an alarm is generated (28). After generation of the alarm (28) or if all requirements set forth by rules are complied with, the person identifiers are checked (18) again.

Figure 6:
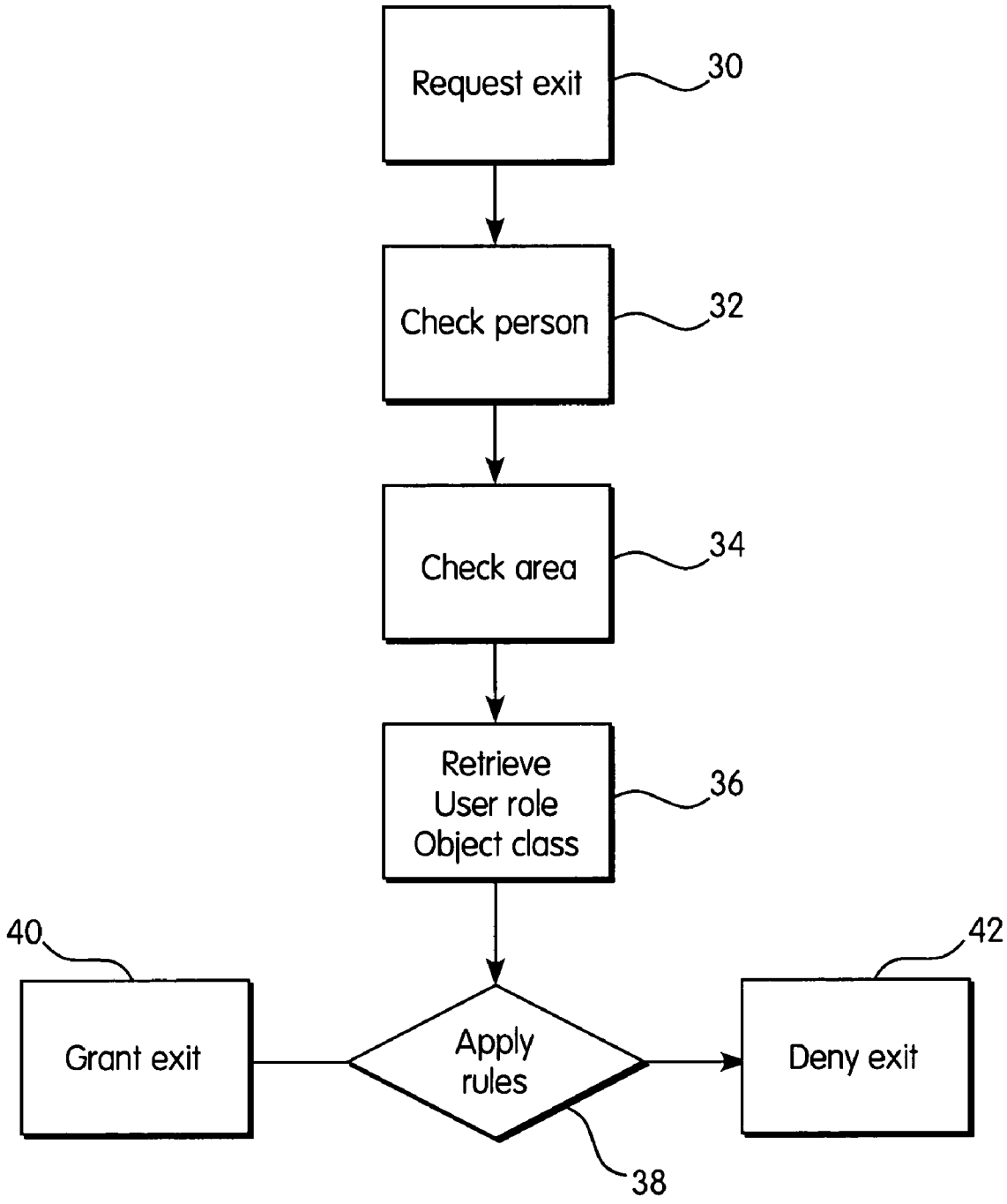
FIG. 6 is a further flow chart illustrating example operations of the systems of FIGS. 1–4.

FIG. 6 shows an exemplary flow chart of a method for granting or denying exit from (or access to) an area. In case a person requests exit from a room (30), the person identifiers are checked (32). In addition, the area that the user wants to exit is checked (34), as is done in step (18, 20) shown in FIG. 5. The user roles of the users in the area and the user requesting exit as well as the object classes are retrieved (36) as already depicted in FIG. 5 within the steps (22, 24). The information about the user roles and the object classes is used to apply rules (38).

If compliance with the rules would still be in effect after the user has exited the area, exit is granted (40). On the other hand, if the user exiting the room has a user role that is required within the room and no other user having this user role is within the room, exit is denied (42).

Given the inventive method and the inventive system, monitoring of areas is possible. Security and safety may be increased, as user roles and object classes may be accounted for. Certain rules may define combinations of persons and objects are required within particular areas, perhaps based on user roles, object classes, or object states of the persons and objects, or combinations thereof. In this way, individuals such as, for example, the elderly or the very young, may receive improved supervision. Moreover, by ensuring proper supervision and use of dangerous objects including, for example, chemicals, radioactive materials, and electrical appliances, a potential for expensive damages is reduced.

What is claimed is:

1. A security system for monitoring objects and persons, the security system comprising:

a classifier operable to associate a person identifier and user role with each of the persons and further operable to associate an object identifier and object class with each of the objects, wherein a person identifier is unique to a corresponding person, and wherein a user role comprises a classification of a person into a group with members having predefined attributes;

an identification interrogator operable to identify which of the object and person identifiers are currently present within an area;

a rule generator operable to implement rules defining which persons of designated user roles and which objects of designated object classes are allowed or required within the area; and a controller in communication with the identification interrogator and operable to determine whether identified object and person identifiers comply with the rules.

2. The security system of claim 1, wherein the person identifiers or the object identifiers include wirelessly accessible tags.

3. The security system of claim 1, wherein the objects are accessible using a power line for providing electrical power.

4. The security system of claim 1, wherein the controller provides an alarm signal when the identified object or person identifiers do not comply with the rules.

5. The security system of claim 1, further comprising an access controller operable to control access to the area such that one of the persons is allowed to enter or exit the area only if the identified object or person identifiers still comply with the rules after the person has entered or exited the area.

6. The security system of claim 5, wherein the rules define the user roles such that access to, or exit from, the area by the associated persons is determined in combination with designated objects of an object class.

7. The security system of claim 1, wherein the interrogator is operable to identify object states, and wherein the rule generator is operable to implement rules defining which persons are allowed or required within the area based on the user roles and the object states.

8. The security system of claim 1, further comprising a central database connected to the controller and providing the user role for each identified person or the object class for each identified object.

9. The security system of claim 8, wherein the rule generator is connected to the central database and retrieves the rules from the central database.

10. A security system for monitoring objects and persons, the security system utilizing person identifiers assigned to the persons, where each person identifier is assigned to at least one user role, where object identifiers are assigned to the objects, where each object identifier is assigned to at least one object class, where a person identifier is unique to a corresponding person, and where a user role comprises a classification of a person into a group with members having predefined attributes, the security system comprising:

an identification interrogator configured to identify object and person identifiers within an area;

a central database configured to provide user roles for each identified person and object class for each identified object;

a rule generator configured to generate rules from information from the central database, the rules defining which persons of which user roles, together with which objects of which object classes, are allowed or required within the area;

a controller configured to check whether identified object and person identifiers comply with the rules; and an access controller configured to control access to the area such that one of the persons is allowed to enter or exit the area only if the identified object and person identifiers still comply with the rules after the person has entered or exited the area.

11. A method for monitoring persons and objects, the method comprising:

interrogating person identifiers assigned to the persons, where each interrogated person identifier is assigned to at least one user role, to thereby obtain an identified person, wherein a person identifier is unique to a corresponding person, and wherein a user role comprises a classification of a person into a group with members having predefined attributes;

interrogating object identifiers assigned to the objects, where each object identifier is assigned to at least one object class, to thereby obtain an identified object;

determining rules defining which persons and which objects are allowed or required within the area based on the user roles and the object classes; and checking whether the identified person and object comply with the rules.

12. The method of claim 11, wherein interrogating the person and object identifiers comprises interrogating wirelessly accessible tags.

13. The method of claim 11, wherein interrogating the object identifiers comprises accessing objects through a power line providing electrical power.

14. The method of claim 11, further comprising providing an alarm signal when the identified person or object do not comply with the rules.

15. The method of claim 11, further comprising controlling access to the area such that a given one of the persons is allowed to enter or exit the area only if the identified person or object still complies with the rules after the given person has entered or exited the area.

16. The method of claim 15, wherein determining the rules comprises defining a combination of user roles and objects of an object class to which access to, or exit from, the area is allowed.

17. The method of claim 11, further comprising identifying object states, wherein determining the rules comprises defining which persons are allowed or required within the area based on the user roles and the object states.

18. The method of claim 11, further comprising:

connecting to a central database; and providing a user role for each identified person or an object class for each identified object using the central database.

19. The method of claim 18, further comprising connecting the rule generator to the central database and retrieving the rules from the central database.

20. A computer program product for use in monitoring persons and objects, the computer program product comprising a at least one machine-readable medium for storing instructions operable to cause at least one processing device to:

instruct an interrogator to interrogate person identifiers assigned to the persons, where each person identifier is assigned to at least one user role, and to interrogate object identifiers assigned to the objects, where each object identifier is assigned to at least one object class, where a person identifier is unique to a corresponding person, and where a user role comprises a classification of a person into a group with members having predefined attributes; and instruct a rule generator to determine rules defining combinations of persons, user roles, objects, and object classes that are allowed or required within the area; and check whether identifiers currently present within the area comply with the rules.

21. The computer program product of claim 20, further comprising instructions operable to cause the at least one processing device to interrogate wirelessly accessible tags.

22. The computer program product of claim 20, further comprising instructions operable to cause the at least one processing device to access objects through a power line providing electrical power.

23. The computer program product of claim 20, further comprising instructions operable to cause the at least one processing device to provide an alarm signal in case currently-present identifiers do not comply with the rules.

24. The computer program product of claim 20, further comprising instructions operable to cause the at least one processing device to control access to the area such that a given one of the persons is allowed to enter or exit the area only if currently-present identifiers still comply with the rules after the given person has entered or exited the area.

25. The computer program product of claim 24, further comprising instructions operable to cause the at least one processing device to define rules defining combinations of user roles and objects of an object class to which access to, or exit from, the area is allowed.

26. The computer program product of claim 20, further comprising instructions operable to cause the at least one processing device to identify object states, and to determine rules defining combinations of user roles, object classes, and object states that are allowed or required within the area.

27. The computer program product of claim 20, further comprising instructions operable to cause the at least one processing device to connect a central database to a controller to thereby provide a user role for each identified person and/or an object class for each identified object.

28. The computer program product of claim 27, further comprising instructions operable to cause the at least one processing device to connect the rule generator to the central database and to retrieve the rules from the central database.

* * * * *